US005911097A

United States Patent [19]

Haga et al.

[11] Patent Number: 5,911,097

[45] Date of Patent: Jun. 8, 1999

[54] IMAGE FORMING APPARATUS AND METHOD USING CHARGE CONTROL MEANS

[75] Inventors: Masayasu Haga, Toyokawa; Tsugihito Yoshiyama, Toyohashi; Yasuhiro Nakagami, Toyokawa; Masami Matsuura, Toyohashi; Akira Hirota, Okazaki, all of Japan

[73] Assignee: Minolta Co., Ltd., Osaka, Japan

[21] Appl. No.: 09/042,670

[22] Filed: Mar. 17, 1998

[30] Foreign Application Priority Data

| | | | |
|---|---|---|---|
| Mar. 18, 1997 | [JP] | Japan | 9-064016 |
| Mar. 25, 1997 | [JP] | Japan | 9-071502 |
| Mar. 27, 1997 | [JP] | Japan | 9-076276 |

[51] Int. Cl.[6] ..... G03G 15/02; G03G 21/00

[52] U.S. Cl. ..... 399/174; 399/128; 430/902

[58] Field of Search ..... 399/168, 174, 399/176, 175, 343, 357, 128; 430/902

[56] References Cited

U.S. PATENT DOCUMENTS

| | | | |
|---|---|---|---|
| 4,669,864 | 6/1987 | Shoji et al. . | |
| 4,769,676 | 9/1988 | Mukai et al. | 399/357 X |
| 5,161,084 | 11/1992 | Morihara et al. | 399/168 X |
| 5,164,779 | 11/1992 | Araya et al. . | |
| 5,192,974 | 3/1993 | Ikegawa et al. . | |
| 5,557,375 | 9/1996 | Nagayasu et al. . | |
| 5,689,777 | 11/1997 | Yamamoto et al. | 399/174 |

FOREIGN PATENT DOCUMENTS

| | | |
|---|---|---|
| 59-201066 | 11/1984 | Japan . |
| 3-456476 | 7/1991 | Japan . |
| 4-304476 | 10/1992 | Japan . |
| 5-134589 | 5/1993 | Japan . |
| 5-204228 | 8/1993 | Japan . |
| 6-289687 | 10/1994 | Japan . |

*Primary Examiner*—S. Lee

*Attorney, Agent, or Firm*—Burns, Doane, Swecker & Mathis, L.L.P.

[57] ABSTRACT

Applied voltage to the contact charging sheet 71 has been controlled in the following various ways: a) the voltage at the photosensitive layer 10 at a point of time whereat it has passed the contact charging sheet 71 is caused to interlock with grid voltage so as not to exceed predetermined voltage to be electrified by the Scorotron charger 2; b) the applied voltage is caused to interlock with the output from the transfer unit 5 so that there is no portion which reaches the Scorotron charger 2 while the potential polarity has been reversed at the transfer unit 5; c) reduction in the film thickness of the photosensitive layer 10 is corrected in consideration of the cumulative number of sheets for image formation; d) the size of printing sheet is added; e) at the time of termination, a portion of the photosensitive layer 10, into which current has flowed at the transfer unit 5, is caused to stop always after passing the contact charging sheet 71; f) the contact charging sheet 71 is cleaned by means of AC component; and g) the applied voltage is switched while formation of an electrostatic latent image and the like are not performed. Thereby, the surface potential at the photosensitive drum 1 is prevented from becoming ununiform.

23 Claims, 9 Drawing Sheets

IMAGE FORMING APPARATUS AND METHOD USING CHARGE CONTROL MEANS

This application is based on applications Nos. 9-64016, 9-71502, and 9-76276 filed in Japan, the contents of which is hereby incorporated by reference.

BACKGROUND OF THE INVENTION

1. Field of the Invention

The present invention relates to formation of an image by transferring an image on an image bearing member onto a recording medium, more particularly, an image forming apparatus provided with contact type charging means for imparting charge to a surface layer on the image bearing member prior to electrifying operation by electrifying means to uniformize electrified potential, and a method therefor, or an image forming apparatus from which image noise resulting from switching of applied state of bias voltage to this charged member has been removed, and further an image forming apparatus capable of removing foreign matter accumulated on a contact place between the charged member and the image bearing member, and preventing the quality of an image to be formed from being deteriorated.

2. Related Art

In an image forming apparatus of the electrophotographic method such as a copying machine, a printer, or a facsimile apparatus, it is arranged such that after an image on an image bearing member is transferred onto a recording medium, residual toner is cleaned, and thereafter, it is electrified by electrifying means (such as a corona electrifying unit) again for the next image formation. In this field of image forming apparatus, the demand for stability of an image has become very severe mainly due to causes such as generalization of color image forming apparatus in recent years. For this reason, it is more and more important to secure the uniformity in surface potential on an image bearing member in a state electrified by electrifying means. To this end, there have been proposed various techniques in which auxiliary electrifying means is provided separately from the major electrifying means, or if charge of inverse polarity occurs on the image bearing member by transfer, de-electrifying means for removing it is provided, and charge is imparted to the image bearing member by auxiliary electrifying means prior to the major electrifying means to enhance the uniformity in surface potential on the image bearing member. They are disclosed in, for example, Japanese Patent Laid-Open Application Nos. 6-289687 and 5-134589 and the like. Also, there has been proposed a contact electrifying device in, for example, Japanese Patent Laid-Open Application No. 4-249270, in which a filmy member (hereinafter, referred to simply as "film"), whose one side comes into contact with the image bearing member, is provided, and bias voltage is applied to this film to impart charge to the image bearing member for electrifying its surface.

In an image forming apparatus according to these related arts, however, since a contact charging member is used also for the main electrifying means or only for opposite-polarity charge generated on the image bearing member by transfer is de-electrified even if de-electrifying means is provided, the ununiformity of the surface potential on the image bearing member could not always be removed sufficiently. Particularly when the potential at which the surface of the image bearing member is electrified by the auxiliary electrifying means exceeds the electrified potential at the main electrifying means, there have been some cases where such surplus potential cannot be absorbed by the main electrifying means, but an image of the next cycle is formed while ununiform potential remains. Therefore, the ununiformity in the surface potential of the image bearing member may appear as noise in the image, resulting in deteriorated image quality.

As another problem, foreign matter (such as paper dust, toner, and photosensitive layer material) accumulates at a contact place between the image bearing member and the contact charging member by the use to change the charging performance, thus affecting the quality of an image to be formed. For this reason, it is necessary to maintain the charging performance by cleaning to remove the foreign matter with an appropriate frequency. As a conventional example of such cleaning, there is a contact electrifying device described in Japanese Patent Laid-Open Application No. 8-69152. In this contact electrifying device, the contact charging member is provided with two chargeable areas in such a manner that they are alternately used and retraction and cleaning are performed during alternation. In this contact electrifying device, however, the size of the contact charging member tends to become large because two chargeable areas must be provided, and further, moving means for making them movable is required. Accordingly, if this device is used, the image forming apparatus tends to become complicated and large, which is against downsizing which has been strongly demanded in recent years.

Also, since a filmy member is caused to come into contact with the image bearing member, an electrostatic attraction force occurs between the image bearing member and the film by the application of bias voltage to this film. Since this electrostatic attraction force is a resistance factor to driving of the image bearing member, the magnitude of torque required for driving the image bearing member differs depending on the applied state of the bias voltage to the film. For this reason, driving unevenness may occur on the image bearing member. Of course, it is possible to control so as to correct the driving torque of the image bearing member in accordance with the applied state of bias voltage, but it is still difficult to completely eliminate driving unevenness in the moment the applied state of bias voltage is switched. Accordingly, when the bias voltage is switched while an image formation process such as formation of an electrostatic latent image on the image bearing member is being performed, stripe-pattern (lengthwise direction of the image bearing member) noise resulting from driving unevenness of the image bearing member appears in the image, thus deteriorating the image quality. This noise is more noticeable in the case of an image forming apparatus which writes an electrostatic latent image by the digital exposure method. As a process in which switching of bias voltage while the process is being performed thus may cause noise, there is a transfer process of a toner image onto a recording medium such as a printing sheet from the image bearing member in addition to the formation of an electrostatic latent image.

The present invention has been achieved in order to solve the aforesaid problems of conventional image forming technique. Namely, the object is to provide an image forming apparatus capable of preventing the surface potential of the image bearing member from becoming ununiform, and obtaining a high-quality image free from noise, and a method therefor. Also, the object is to provide an image forming apparatus, in simple and compact structure, capable of maintaining the electrifying performance by removing foreign matter accumulated at a contact place between the image bearing member and the contact charging member to thereby maintain the image quality. Further, the arrangement is made such that the switching of the applied state of the bias voltage on the contact charging member for that end is prevented from causing image noise.

SUMMARY OF THE INVENTION

An image forming apparatus according to the present invention made to solve the problems comprises: an image bearing member; electrifying means for electrifying the surface of the image bearing member; latent image forming means for forming an electrostatic latent image on the surface of the image bearing member electrified by the electrifying means; development means for visualizing an electrostatic latent image formed by the latent image forming means; transfer means for transferring the image visualized by the development means; charging means for imparting charge to the surface of the image bearing member in a position behind the transfer means and before the electrifying means; and charge control means for controlling the applied voltage of the charging means so that the surface potential of the image bearing member does not exceed predetermined potential. The charging means preferably includes a contact member rubbed with the surface of the image bearing member, and the contact member is preferably sheet-shaped (film, blade, and the like may be used).

In this image forming apparatus, when the surface of the image bearing member is electrified by the electrifying means, an electrostatic latent image is formed on the surface electrified by the latent image forming means. The electrostatic latent image is visualized by the development means, and the image visualized is transferred by the transfer means. Thus, the image is formed. In a position behind the transfer means and before the electrifying means, charge is imparted to the surface of the image bearing member by the charging means. For this reason, voltage (bias voltage) is applied to the charging means. This applied voltage is controlled by the charge control means so that the surface potential of the image bearing member does not exceed the predetermined potential. Accordingly, the surface potential of the image bearing member at a point of time whereat charge has been imparted by the charging means does not exceed the predetermined potential. For this reason, when the surface of the image bearing member is electrified by the electrifying means, the whole is at the predetermined potential uniformly, and is free from potential unevenness which causes image noise. Since the image is formed in this state, a high-quality image can be formed.

In this case, the "predetermined potential", which is used by the charge control means to control the charging means, is preferably potential at which the surface of the image bearing member is electrified by the electrifying means. Also, the actual applied voltage of the charging means is controlled by the charge control means in accordance with transfer voltage of the transfer means, a cumulative number of times, an image formation area and other image formation conditions of the image forming operation. In this respect, such an image forming apparatus has normally cleaning means for cleaning the surface of the image bearing member behind the transfer means and before the charging means. Also, the charging means is preferably opposite in polarity to the transfer means.

In an image forming apparatus according to the present invention, the voltage applied to the charging means by the control of the charge control means may be DC voltage, oscillating voltage, or may be the DC voltage and oscillating voltage which are superposed. If a component of oscillating voltage is contained in the applied voltage, it provides a cleaning effect of the charging means. Since an electric coulomb force between the contact member of the charging means and the image bearing member is also varied repeatedly by the oscillating component, the contact member oscillates relative to the image bearing member. This oscillation removes foreign matter accumulated at a contact place between the contact member and the image bearing member. When the foreign matter is removed and the contact place becomes clean, the image bearing member is satisfactorily charged by application of voltage. Namely, the charging (or de-electrifying) performance of the contact member is recovered so that potential on the surface of the image bearing member can be uniformly adjusted. In this respect, the oscillating voltage is voltage which varies repeatedly, and is represented by AC voltage (not always sine waveform). It may be two levels of DC voltage which take turns repeatedly (positive/negative, on/off, high/low). In this respect, cleaning of the contact member by application of oscillating voltage is preferably performed only with the oscillating voltage component when the driving speed of the image bearing member is reduced or stopped except during image forming operation.

In an image forming apparatus according to the present invention, the applied voltage to the charging means under the control of the charge control means may be switched from any of DC voltage, oscillating voltage, and from the DC voltage and oscillating voltage which are superposed, to any thereof. The switching of this applied voltage is preferably performed while neither formation of an electrostatic latent image by the latent image forming means nor transfer by the transfer means is being performed. Also, when both applied voltage of the charging means and output from the transfer means are switched, the output from the transfer means is preferably switched first.

Namely, according to the present invention, there are provided an image forming apparatus and an image forming method capable of obtaining a high-quality image free from noise by preventing the surface potential at the image bearing member from becoming ununiform. More particularly, the surface potential at the image bearing member is prevented from exceeding predetermined potential to be electrified at the electrifying means before it is reached to thereby uniformize the surface potential at a point of time whereat it has passed the electrifying means. Also, even if the output from the transfer means fluctuates, a place on the image bearing member whose surface potential polarity has been reversed is prevented from reaching the electrification means to thereby uniformize the surface potential at a point of time whereat it has passed the electrifying means. Also, the uniformity of the surface potential at a point of time whereat it has passed the electrifying means can be maintained even if it is repeatedly used, to say nothing of while it is new. Also, irrespective of the size of the recording medium, the uniformity of the surface potential at a point of time whereat it has passed the electrifying means can be secured. Also, when image formation is performed again after image formation has been completed, the un-uniformity of surface potential at the image bearing member can be prevented, thus making it possible to obtain a high-quality image free from noise.

Also, by removing foreign matter accumulated on a contact place between the image bearing member and the contact member, it is possible to maintain the electrifying performance for maintaining the image quality and obtaining simple and compact structure. Further, oscillation noise of the contact member is restrained and introduction of foreign matter into the contact member during cleaning is also prevented. In addition, switching of applied state of bias voltage to the contact member is prevented from causing image noise.

DETAILED DESCRIPTION OF PREFERRED EMBODIMENT

Figure 1:
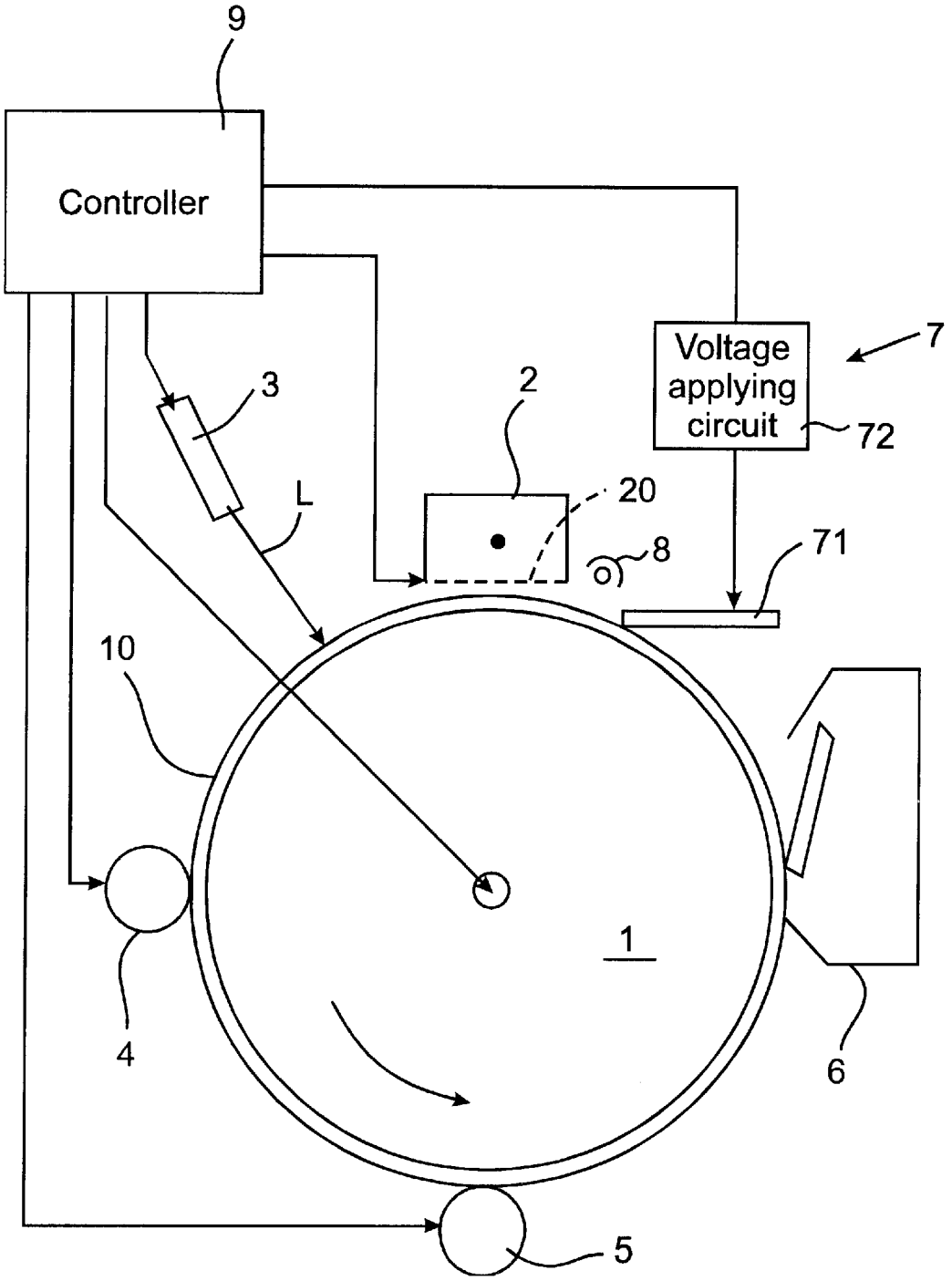
FIG. 1 is a view for explaining schematic structure of an image forming apparatus according to an embodiment.

Now, hereinafter, an embodiment embodying the present invention will be described in detail with reference to the drawings. In an image forming apparatus according to this embodiment, roughly as shown in FIG. 1, there are, around a cylindrical photosensitive drum 1, arranged a Scorotron charger 2, a laser exposure device 3, a developer unit 4, a transfer unit 5, a cleaner 6, a charging device 7, and a photo-deelectrifying unit 8, and a controller 9 for generally controlling the entire image forming apparatus is provided.

The photosensitive drum 1 is formed with a photosensitive layer 10 on the surface, and is adapted to rotate in the anticlockwise direction in the figure under the control of the controller 9. In this photosensitive drum 1, the photosensitive layer 10 is electrified by the Scorotron charger 2, an electrostatic latent image is written on the photosensitive layer 10 electrified by the laser exposure device 3, the electrostatic latent image is developed in the developer unit 4, that is, toner is imparted, and the toner image is carried to the transfer unit 5. In other words, the photosensitive drum 1 is an image bearing member.

The Scorotron charger 2 is used to electrify the photosensitive layer 10 of the photosensitive drum 1 at predetermined potential, and has a grid 20 for controlling the electrified potential of the photosensitive layer 10. The voltage of the grid 20 is controlled by the controller 9. The laser exposure device 3 forms an electrostatic latent image by irradiating laser light L to the photosensitive layer 10 which is electrified at predetermined potential by the Scorotron charger 2. For this reason, it is adapted to receive image data from the controller 9 and scan the laser light L in accordance therewith.

The developer unit 4 imparts toner to the electrostatic latent image on the photosensitive layer 10 to form a toner image. To this end, replenishment, agitation, and circulation of toner are performed under the control of the controller 9. The transfer unit 5 transfers a toner image on the surface of the photosensitive drum 1 onto a recording medium (hereinafter, referred to simply as "printing sheet") such as a printing sheet. For this reason, the transfer unit 5 is adapted to apply to the photosensitive drum 1 an electric field that is opposite in polarity to an electric field applied to the photosensitive drum 1 by the Scorotron charger 2 under the control of the controller 9.

The cleaner 6 removes toner remaining on the surface of the photosensitive drum 1 after transfer so as to prevent an image to formed next time from being stained.

The charging device 7 has a contact charging sheet 71, which is a sheet-shaped member with a thickness of about 0.1 mm. The contact charging sheet 71 is held in such a manner that its end portion is in contact with the surface of the photosensitive drum 1 at an angle of contact of about 20° in the direction away from its rotation. This contact charging sheet 71 serves to impart charge to the photosensitive layer 10, from which the residual toner has been removed by the cleaner 6, for adjusting the potential at the photosensitive layer 10. Namely, the contact charging sheet 71 is a contact member. Its material is obtained by dispersing finely divided particles of carbon in nylon resin so that the surface resistance falls within the range of $10^3$ to $10^9\Omega/\square$ (preferably within the range of $10^4$ to $10^7\Omega/\square$). In this respect, there may be used those obtained by using polyimide resin, polycarbonate resin, fluoroplastic, ETFE, PVdF, or the like in place of nylon resin, and further by dispersing finely divided particles of carbon in any of them or their mixture to adjust to such surface resistance as described above. Also, ion conductive resin, whose surface resistance is within the above-described range, may be used. This contact charging sheet 71 is connected to the controller 9 through a voltage applied circuit 72 so that the voltage is controlled. Its polarity is the same (however, the voltage value is not always the same) as that of the Scorotron charger 2, that is, it is opposite in polarity to the transfer unit 5.

Figure 2:
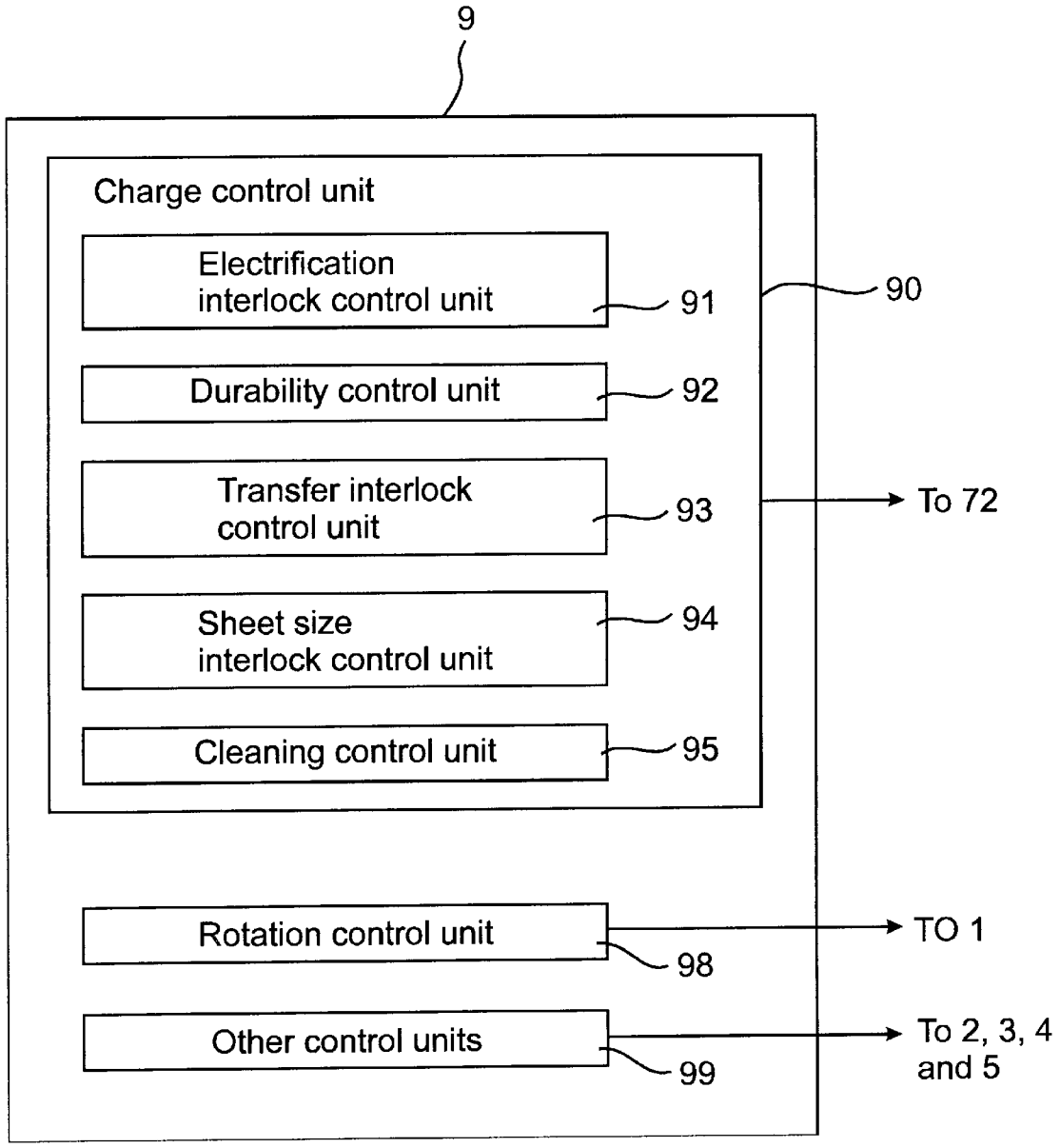
FIG. 2 is a block diagram showing structure of a controller of the image forming apparatus.

The photo-deelectrifying unit 8 removes extra charge by irradiating light onto the surface of the photosensitive drum 1. The controller 9 for generally controlling these components is a microcomputer comprising well-known CPU, ROM, RAM, and the like, and has functions of controlling each device such as the Scorotron charger 2 and developer unit 4 described above. Of these control functions, it is voltage control of the contact charging sheet 71 which is performed through the voltage applied circuit 72 that is particularly important in the present application. Namely, the controller 9 includes a role as the charge control means, and also a role of controlling rotation of the photosensitive drum 1 in its functions. To the end, the controller 9 is, as shown in FIG. 2, provided with a charge control unit 90, a rotation control unit 98, and other control units 99. The charge control unit 90 is further provided with an electrification interlock control unit 91, a durability control unit 92, a transfer interlock control unit 93, a sheet size interlock control unit 94, and a cleaning control unit 95. The detail of these controls will be described later.

An image forming apparatus having the above-described structure forms an image in the following way. When the photosensitive drum 1 rotates in the anticlockwise direction in the figure, its photosensitive layer 10 is electrified at predetermined potential on passing the Scorotron charger 2. Its potential is substantially equal to the voltage (hereinafter, referred to as "grid voltage", and represented by $V_G$) at the grid 20. When a portion of the photosensitive layer 10 which has been electrified at predetermined voltage reaches an exposure position (position facing to the laser exposure device 3) by rotation of the photosensitive drum 1, the portion is irradiated with laser light L in accordance with the image data to form an electrostatic latent image. Thus, when the electrostatic latent image reaches the developer unit 4 by rotation of the photosensitive drum 1, toner is supplied there to form a toner image on the electrostatic latent image. Thereafter, the photosensitive drum 1 rotates with the toner image borne on the surface thereof.

When the toner image reaches the transfer unit 5, a transfer electric field is applied to the photosensitive layer 10 from the transfer unit 5, whereby the toner image is attracted and is transferred onto a recording sheet. The transfer electric field at this time is opposite in polarity to the electric field applied to the photosensitive layer 10 when electrifying by the Scorotron charger 2. Therefore, the potential at the photosensitive layer 10 is affected by it and changes, and there may be partially a place where the polarity when electrified by the Scorotron charger 2 is reversed. After the toner image has passed the transfer unit 5, a little toner remains where the toner image was on the photosensitive layer 10, but when the cleaner 6 is reached, it is removed there.

When the contact charging sheet 71 is reached, charge is imparted to the photosensitive layer 10 by the contact charging sheet 71 voltage-controlled to the same polarity as the Scorotron charger 2. Also, the photosensitive layer 10 is irradiated with light by the photo-deelectrifying unit 8. This adjusts the potential so as not to exceed the predetermined voltage value to be electrified by the Scorotron charger 2 while returning the place, where the potential polarity has been reversed on passing the transfer unit 5, to the correct polarity again. If there is a place where the potential polarity remains reversed, or a place where the predetermined voltage value to be electrified by the Scorotron charger 2 is exceeded, the potential at the place cannot be returned to the predetermined potential by the Scorotron charger 2, but noise enters an image to be formed next time. Also, since foreign matter such as paper dust, toner, and photosensitive layer material may accumulate on the contact portion between the contact charging sheet 71 and the photosensitive drum 1 due to the use, a cleaning process (which is different from removal of residual toner from above the photosensitive layer 10 using the cleaner 6) for removing foreign matter as described later will also be performed.

Figure 3:
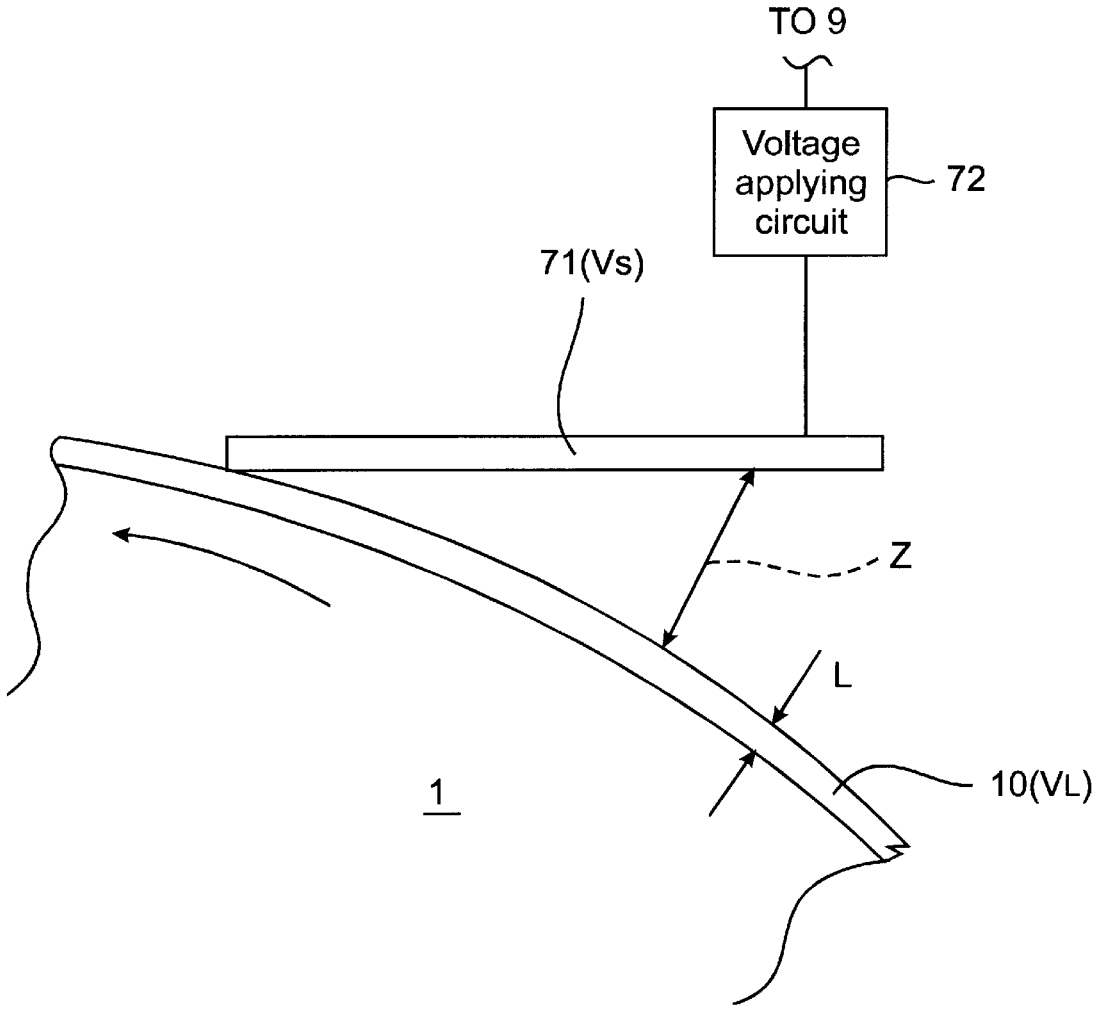
FIG. 3 is an enlarged view showing the periphery of a contact charging sheet.

Thus when the Scorotron charger 2 is reached, the photosensitive layer 10 is electrified to the predetermined potential again and is caused to be ready for forming the next image. At this time, the potential is already adjusted at the contact charging sheet 71 and the photo-deelectrifying unit 8 prior to the electrification at the Scorotron charger 2, and there exists neither place whose polarity has been reversed nor place whose voltage value exceeds the predetermined voltage. Therefore, highly-uniform electrification is performed and a high-quality image is formed. The above-described operation is performed under the generalized control of the controller 9. Of the above-described operations, the potential adjustment at the photosensitive layer 10 in the contact charging sheet 71 will be further described in detail. In the vicinity of the contact position between the contact charging sheet 71 and the photosensitive drum 1 as shown in FIG. 3, representing the film thickness of the photosensitive layer 10 by L ($\mu$m) and the void distance between the contact charging sheet 71 and the photosensitive drum 1 by z ($\mu$m), void voltage $V_Z$ applied to the void is represented by the following equation:

$$V_Z=(V_S-V_L)\cdot z/(z+(L/\epsilon_R)) \quad (1)$$

where $V_S$ represents applied voltage (which is controlled by the charge control unit 90 of the controller 9) to the contact charging sheet 71, $V_L$ represents the potential at the photosensitive layer 10, and $\epsilon_R$ represents specific inductivity of the photosensitive layer 10. Taking notice of a certain point in the photosensitive layer 10, the void voltage $V_Z$ becomes lower as it approaches the contact charging sheet 71 by the rotation of the photosensitive drum 1. Since, however, the void distance z more heavily reduces, the electric field applied to the void rather becomes stronger, thus causing discharge somewhere. Relationship between voltage $V_P$ and void distance z which is required to cause discharge in a void is known as Paschen's formula which is shown as follows:

$$V_P=312+6.2\cdot z \quad (2)$$

Accordingly, discharge begins at a point of time whereat equation (1) and equation (2) intersect, and discharge continues while $V_P$ is lower than $V_Z$. This discharge causes charge to be imparted to the photosensitive layer 10 from the contact charging sheet 71. For this reason, the potential V at the photosensitive layer 10 rapidly approaches the voltage $V_S$ at the contact charging sheet 71 so that the void voltage $V_Z$ becomes low. Thus, when equation (1) and equation (2) intersect again, the discharge is terminated. The potential $V_L$ at the photosensitive layer 10 at this point of time is determined by both the applied voltage $V_S$ to the contact charging sheet 71 and the film thickness L of the photosensitive layer 10, and is given by the following equation:

$$V_L=V_S-((7737.6\cdot L/\epsilon_R)^{1/2}+312+6.2\cdot L/\epsilon_R) \quad (3)$$

In other words, the potential at the photosensitive layer 10 is adjusted by the contact charging sheet 71 as shown by equation (3). Even if there has been a place, in a part of the photosensitive layer 10, whose polarity has been reversed at the transfer unit 5, this adjustment corrects the place to the correct polarity.

Further, the applied voltage $V_S$ at the contact charging sheet 71 is controlled by the electrification interlock control unit 91 of the charge control unit 90 so that the voltage at the photosensitive layer 10 in a state adjusted as described above does not exceed the predetermined voltage to be electrified by the Scorotron charger 2. If the photosensitive layer 10 has a place where the predetermined voltage is exceeded, the Scorotron charger 2 cannot return the potential at the place, but the next image is formed with the potential distribution remained ununiformly, thus deteriorating the image quality.

Therefore, the electrification interlock control unit 91 controls the applied voltage $V_S$ to the contact charging sheet 71 by adding grid voltage $V_G$ and using the relationship shown in the following equation:

$$V_S<V_G+((7737.6\cdot L/\epsilon_R)^{1/2}+312+6.2\cdot L/\epsilon_R) \quad (4)$$

In other words, if the grid voltage $V_G$ varies, the applied voltage $V_S$ to the contact charging sheet 71 is also caused to vary if required. Thereby, the uniformity of electrified voltage at the photosensitive layer 10 at a point of time whereat it has passed the Scorotron charger 2 can be secured, thus obtaining a high-quality image free from noise.

Also, the charge control unit 90 of the controller 9 controls the applied voltage $V_S$ to the contact charging sheet 71 by adding a cumulative number of times of image formation. The reason is that the film thickness L of the photosensitive layer 10 is contained in the equation (4) and that the photosensitive layer 10 is worn away through service history of the image forming apparatus to reduce the film thickness L. According to the equation (4), when the film thickness L becomes smaller, the applied voltage $V_S$ to the contact charging sheet 71 also must be made lower. To this end, the durability control unit 92 of the charge control unit 90 cumulatively counts a number of times of image formation ever since the image forming apparatus was new, and further relationship between the cumulative number of times of image formation and standard film thickness L of the photosensitive layer 10 is prepared as a table. Thus, the film thickness L is determined from the table on the basis of a cumulative number of times counted to determine the applied voltage $V_S$ to the contact charging sheet 71. In this way, a high-quality image free from noise can be obtained even if the apparatus is repeatedly used, to say nothing of when it is new.

Also, the charge control unit 90 of the controller 9 controls the applied voltage $V_S$ to the contact charging sheet 71 by adding output from the transfer unit 5 by means of the transfer interlock control unit 93. The reason is that the equation (3) has been determined under an ideal condition. The ideal condition is that there is sufficient discharge time between the contact charging sheet 71 and the photosensitive layer 10. If the output from the transfer unit 5 is great and a large amount of current flows into the photosensitive layer 10 during transfer, it may pass before the equation (1) and the equation (2) intersect again after discharge begins at the contact charging sheet 71 to terminate the discharging. In this case, it reaches the Scorotron charger 2 while a portion whose potential polarity has been reversed remains on the photosensitive layer 10, and therefore, there arises a case where uneven potential cannot be completely eliminated by the Scorotron charger 2. In this case, noise is likely to appear in the image.

To be specific, some voltage is added to the applied voltage $V_S$ to the contact charging sheet 71 in accordance with the output from the transfer unit 5 with respect to the condition in equation (4). The voltage to be added is determined in the following way. First, as regards the potential at the photosensitive layer 10 at a point of time whereat it has passed the transfer unit 5, it is known that the potential shifts by an amount represented by $V_D$ in the following equation as compared with that before the passage.

$$V_D = K \cdot L \cdot I / (\epsilon_O \cdot \epsilon_R \cdot v \cdot W) \quad (5)$$

where I represents current ($\mu$A, varies with the output from the transfer unit 5) which flows into the photosensitive layer 10 at the transfer unit 5, $\epsilon_O$, dielectric constant of vacuum, v, circumferential speed (m/sec.) of the photosensitive layer 10 by rotation of the photosensitive drum 1, and W, discharge width (m) in the transfer unit 5 respectively. K is a device constant which is determined by the layout and the like of the periphery of the device, and is normally within a range of 1/50 to 1/20. Thus, only an amount determined by equation (5) in accordance with the output from the transfer unit 5 with respect to the condition of equation (4) can be added to the applied voltage $V_S$ to the contact charging sheet 71. This allows, even if great dispersion exists in the potential at the photosensitive layer 10 at a point of time before the contact charging sheet 71 is reached, depending on the output from the transfer unit 5, all opposite-polarity portions to be corrected to correct polarity in the contact charging sheet 71 before the Scorotron charger 2 is reached, thus making it possible to obtain uniform electrification at the Scorotron charger 2 for obtaining a high-quality image free from noise.

Assuming, for example, the circumferential speed v to be 0.16 m/sec, the discharge width to be 0.31 m, the film thickness L of the photosensitive layer 10 to be 25 $\mu$m, its specific inductivity to be 3.3, and the device constant k to be 1/35 respectively, the voltage shift $V_D$ becomes, with respect to the transfer current I, as follows:

| I ($\mu$A) | $V_D$(V) |
|---|---|
| 20 | 9.9 |
| 30 | 14.8 |
| 40 | 19.7 |
| 50 | 25.7 |

Since the transfer current I depends upon the output from the transfer unit 5, the applied voltage $V_S$ to the contact charging sheet 71 can be increased in accordance with the output from the transfer unit 5.

In this respect, the equation (5) includes the discharge width W at the transfer unit 5. The ease of an inflow of current into the photosensitive layer 10 at the transfer unit 5 differs depending on the presence or absence of a printing sheet. For this reason, strictly speaking, if the voltage shift $V_D$ is adjusted according to the size of the printing sheet, further higher-precision control will be able to be performed. More specifically, if the printing sheet is a large one such as size B4 or A3, an area which is not occupied by the printing sheet is smaller and the amount of inflow of current is small by that much, and therefore the voltage shift $V_D$ is made smaller (the device constant K can be made small). Conversely, in the case of a small printing sheet such as a postcard, an area which is not occupied by the printing sheet is large and the amount of inflow of current is that much large, and therefore the voltage shift $V_D$ is made large (the device constant k can be made large). This control is performed by means of the sheet size interlock control unit 94 of the charge control unit 90.

Next, the application of voltage to the contact charging sheet 71 will be further described in detail. Voltage applied from the voltage applied circuit 72 to the contact charging sheet 71 has two modes: DC and AC. DC bias is about −400 V (the same polarity as the electrified voltage of the Scorotron charger 2, and opposite polarity to the transfer voltage of the transfer unit 5), and is controlled in accordance with various conditions as described above. AC bias has peak-peak voltage of about 1.5 kV and a frequency of about 1 kHz. Its waveform is represented by a sine wave or a square wave of duty ratio of 1:1, but other waveforms (such as triangle wave and saw tooth wave) may be used. This AC bias corresponds to "oscillating voltage". Accordingly, it may be replaced with AC voltage by repeatedly switching (positive/negative, on/off, high/low) DC voltage.

The applied sequence of DC bias and AC bias will be described with reference to FIGS. 4 through 6. In the following description, the diameter of the photosensitive drum 1 is 30 mm, and the size of printing sheet is A4 (297 mm wide). In this case, printing itself on a printing sheet requires a little over three revolutions of the photosensitive drum 1. Further, since an image is formed in a state in which the characteristic properties of the photosensitive member have been stabilized, both the Scorotron charger 2 and the photo-deelectrifying unit 8 are caused to be in an output state to cause the photosensitive drum 1 to make 1.5 revolutions at least before and after the image formation. These are referred to as "preliminary treatment", and "additional treatment". Here, both DC bias and AC bias are applied to the contact charging sheet 71 for the reason described later.

First, the sequence of FIG. 4, which is the most basic sequence, will be described. FIG. 4 shows sequence of rotation of the photosensitive drum 1 and application of DC and AC bias voltage to the contact charging sheet 71 when one sheet of printing sheet is printed. More specifically, prior to a start of image formation, the rotation of the photosensitive drum 1 and application of DC and AC bias voltage to the contact charging sheet 71 are started with at timing $t_0$. In synchronism with this timing, all devices (such as electrifying unit 2) excluding exposure and sheet feeding and exhausting are also caused to be in an output state. This is preliminary treatment. In that state, the photosensitive drum 1 is caused to make 1.5 revolutions, and the characteristic properties of the photosensitive member are stabilized (timing $t_1$), and thereafter image formation is started. Namely, the exposure and sheet feeding and exhausting are started.

Thus, when the photosensitive drum 1 rotates (a little over three revolutions) to terminate image formation (timing $t_2$), the exposure, sheet feeding and exhausting and the like are stopped, but bias voltage for the electrifying unit 2, the photo-deelectrifying unit 8 and the contact charging sheet 71 continues the output state as it is. This is additional treatment, and is performed to stabilize the photosensitive member which has formed an image so as not to leave any influence in the next image formation. When the photosensitive drum 1 makes 1.5 revolutions, the additional treatment is terminated (timing $t_3$). At this time, many devices such as the electrifying unit 2 stop their operations, but only the rotation of the photosensitive drum 1 and the application of AC bias voltage to the contact charging sheet 71 continue. This is a cleaning process (which is different from removal of residual toner on the photosensitive drum 1 by the cleaner 6) for the contact charging sheet 71, and the photosensitive drum 1 is caused to make about 0.3 revolution in this state to terminate all the operations (timing $t_4$). This cleaning process is controlled by the cleaning control unit 95 of the charge control unit 90.

Figure 4:
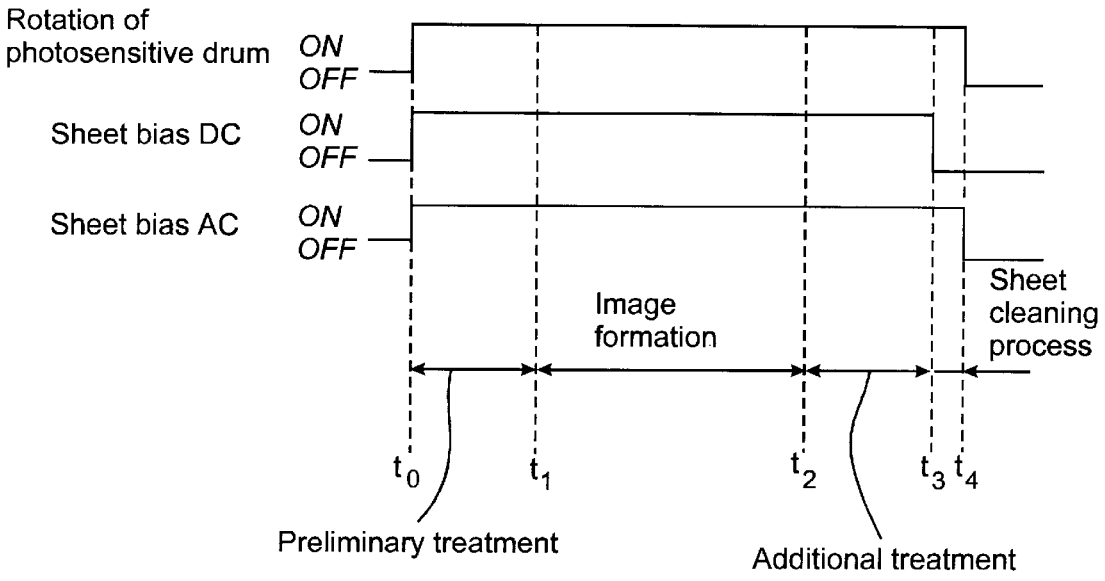
FIG. 4 is a view for explaining sequence of application of bias voltage to the contact charging sheet in the image forming apparatus.

In this sequence of FIG. 4, in the cleaning process at timing $t_3$ through $t_4$ which is performed following the additional treatment, only AC bias voltage is applied to the contact charging sheet 71 from the voltage applied circuit 72. For this reason, the potential at the contact charging sheet 71 relative to the photosensitive drum 1 is repeatedly reversed at a frequency of 1 kHz, and upon this reverse, the electric coulomb force between the two is also reversed at the frequency. In other words, an attraction force and a repulsion force are alternately operating. This causes the tip end of the contact charging sheet 71 to oscillate relative to the photosensitive drum 1, and this oscillation shakes off the foreign matter accumulated on the tip end for removal. When image formation is performed with foreign matter accumulated, the charging performance of the contact charging sheet 71 is not stabilized and the image quality is deteriorated. By the removal of the foreign matter, the charging performance is recovered, resulting in a state in which a high-quality image can be formed. In this respect, since no DC bias voltage is applied at this time, the foreign matter electrified is not introduced into the contact charging sheet 71. Some foreign matter is prone to be electrified like paper filler, and if DC bias is superposed during cleaning, it is very likely to be conversely introduced into the contact charging sheet 71, and therefore, it is prevented. Therefore, the cleaning effect is high.

In such cleaning process, there are cases where oscillation noise strikes our ears according to conditions (for example, in other members nearby, there is one which coincides in resonant frequency) because the contact charging sheet 71 is oscillating. During cleaning process, the developer unit 4 and the transfer unit 5 are stopped, and other noise sources do not exist, and therefore, this oscillation noise becomes still more conspicuous. In order to restrain this oscillation noise, it is effective to reduce the speed of the photosensitive drum 1 during cleaning process as compared with that during normal operation, or to stop its operation. FIG. 5 shows sequence when the photosensitive drum 1 is stopped during cleaning process. In the sequence of FIG. 5, since the photosensitive drum 1 is stopped (mark * in FIG. 5) in the cleaning process at timing $t_3$ through. $t_4$, the oscillation noise is restrained to such a level as not to reach our ears. In the case of performing control to reduce the speed as compared with that during normal operation instead of stopping the photosensitive drum 1 during cleaning process, two levels of high and low are provided for "on" in rotation of the photosensitive drum 1, and high level is used during the preliminary treatment to the additional treatment (timing $t_0$ through $t_3$) and low level is used during cleaning process (timing $t_3$ through $t_4$). In this case, the effect of restraining oscillation noise can be obtained likewise.

In this respect, during cleaning process when control is performed with the transfer unit 5 not caused to be in an output state, a portion of the photosensitive drum 1 which has been electrified by the electrifying unit 2 and at which a high potential is kept maintained is opposed to the contact charging sheet 71. In this case, in order to prevent foreign matter electrified, which has been described in the sequence of FIG. 4, from being introduced, the potential at the contact charging sheet 71 can be made high in accordance with the potential at the photosensitive drum 1. The sequence when such control is performed is shown in FIG. 6.

More specifically, the rotation of the photosensitive drum 1 is started at timing $t_0$, and in synchronism therewith, the output from the electrifying unit 2, the developer unit 4, and the photo-deelectrifying unit 8 is turned on, and further, bias voltage for both DC and AC is applied to the contact charging sheet 71 to start the preliminary treatment. At this point of time, the output from the transfer unit 5 is not turned on. In this respect, FIG. 6 is depicted as if each device started the operation at the same time, but there is actually a time lag due to the rotation of the photosensitive drum 1 (the same applies to other timing). When the photosensitive drum 1 is caused to make 1.5 revolutions in that state to terminate the preliminary treatment (timing $t_1$), exposure and output from the transfer unit 5 (and operation of sheet feeding and exhausting system) are started to form an image. Thus, when the photosensitive drum 1 rotates (a little over three revolutions) to terminate image formation (timing $t_2$), the exposure and the output from the transfer unit 5 (and operation of the sheet feeding and exhausting system) are turned off, and the additional treatment is performed in the same state as in the preliminary treatment.

Thus, when the photosensitive drum 1 is caused to make 1.5 revolutions to terminate the additional treatment (timing $t_3$), other devices are all turned off except for the rotation of the photosensitive drum 1 and the application of bias voltage for both DC and AC to the contact charging sheet 71 to perform the cleaning process therefor. It is a portion of the surface of the photosensitive drum 1, which has been electrified to high potential by the electrifying unit 2, and in which the high potential is maintained substantially as it is because the transfer unit 5 has been turned off during the additional treatment that the contact charging sheet 71 is opposed to at this time. However, since DC bias is also superposedly applied in addition to AC bias (mark * in FIG. 6), the potential at the contact charging sheet 71 is close to that at the surface of the photosensitive drum 1, and foreign matter electrified is not introduced into the contact charging sheet 71. When the photosensitive drum 1 is caused to make 0.3 revolution, the cleaning process is terminated (timing $t_4$). Therefore, the cleaning effect is high.

Figure 5:
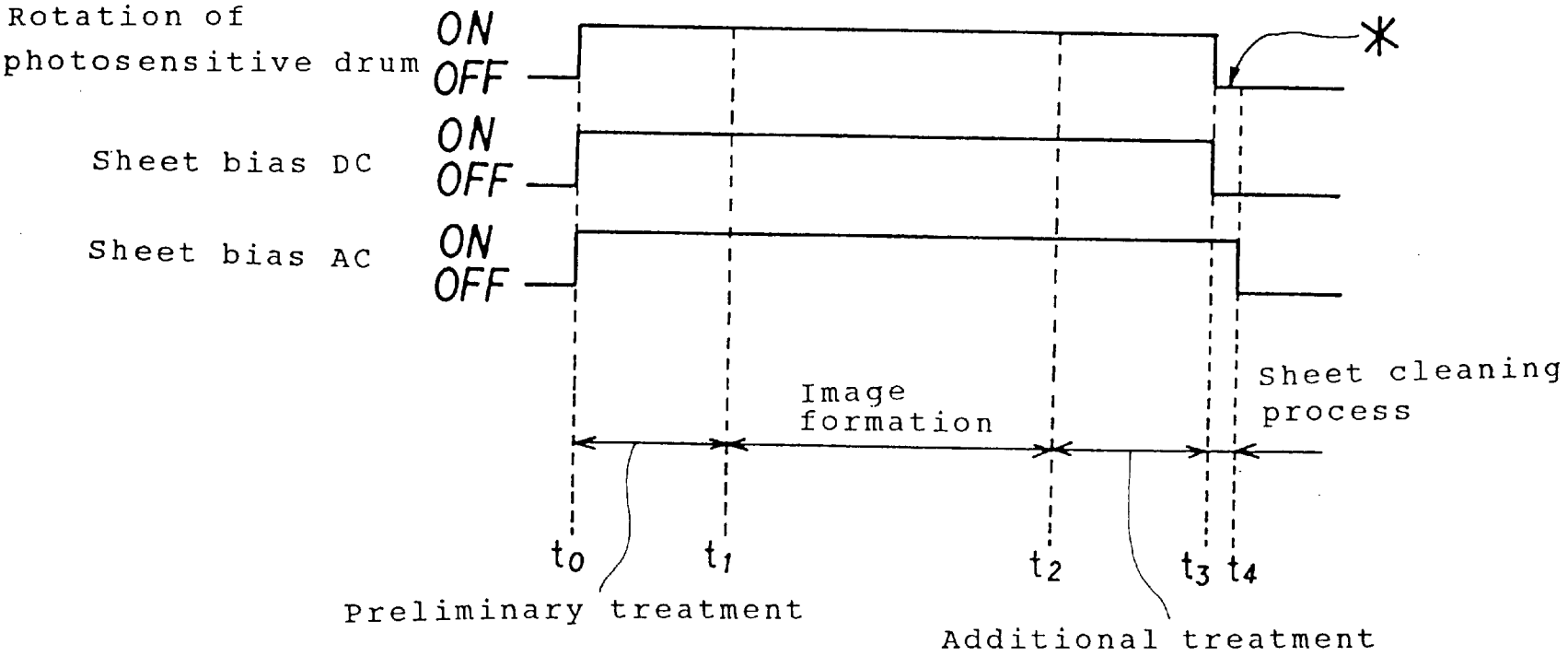
FIG. 5 is a sequence diagram when a photosensitive drum is stopped during cleaning.
Figure 6:
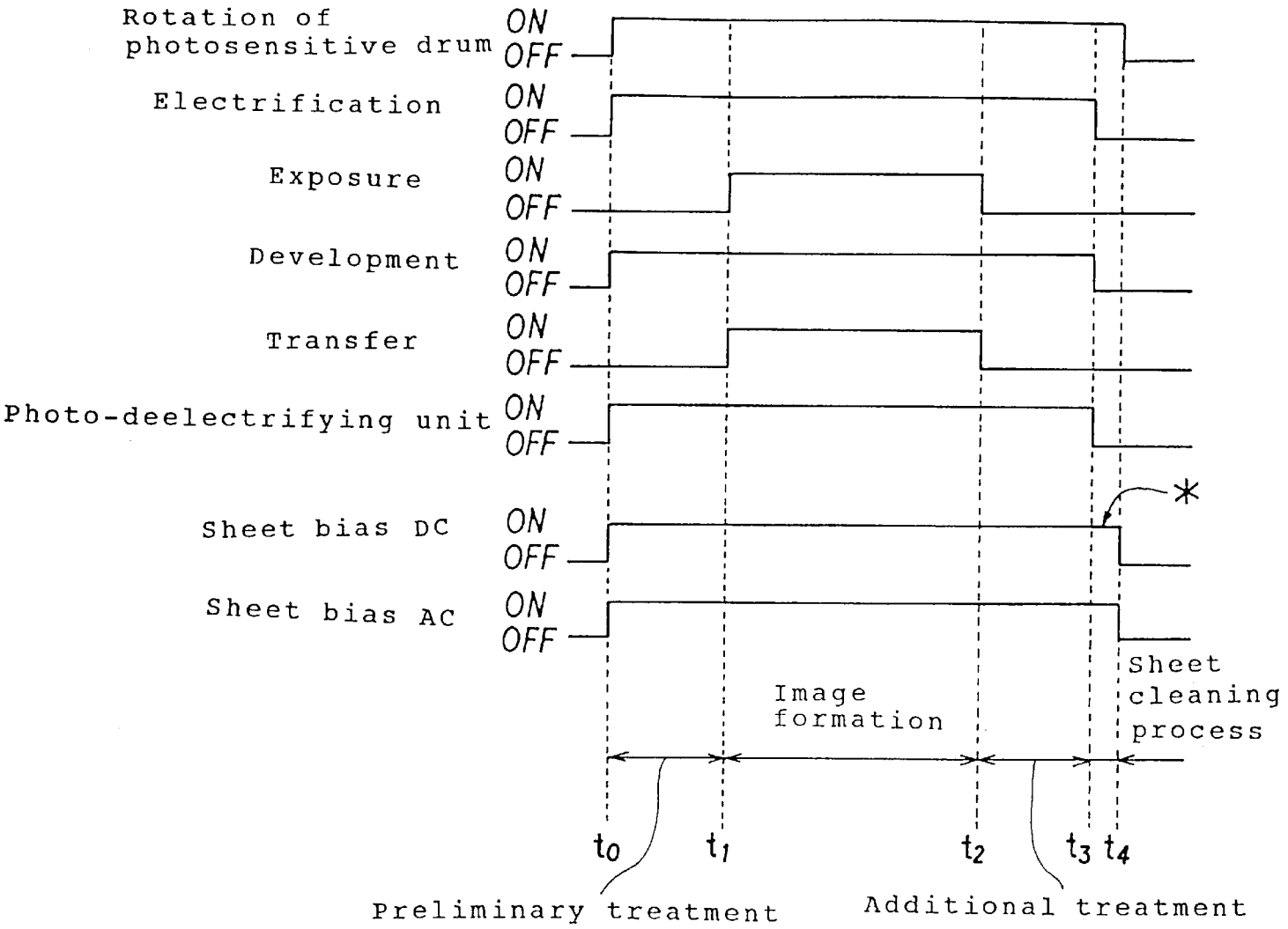
FIG. 6 is a sequence diagram when DC voltage is applied during cleaning.

In the case of performing this control of FIG. 6, the cleaning effect is exhibited during both the preliminary treatment and the additional treatment. In this respect, in FIG. 6, DC bias applied to the contact charging sheet 71 in the cleaning process at timing $t_3$ through $t_4$ was a voltage equal to DC bias during image formation, but it may be adjusted by matching it with the potential on the surface of the photosensitive drum 1. In this case, it frequently becomes a little higher than the DC bias during image formation. Also, as in the case of FIG. 5, the photosensitive drum 1 may be slowed down or stopped.

In this respect, the cleaning process described in FIGS. 4 through 6 does not always have to be executed every time image formation is performed. It suffices if the cleaning process is performed as required according to the accumulated state of foreign matter. For example, a function mode for enabling the user to designate whether or not the cleaning process should be performed may be provided.

Figure 7:
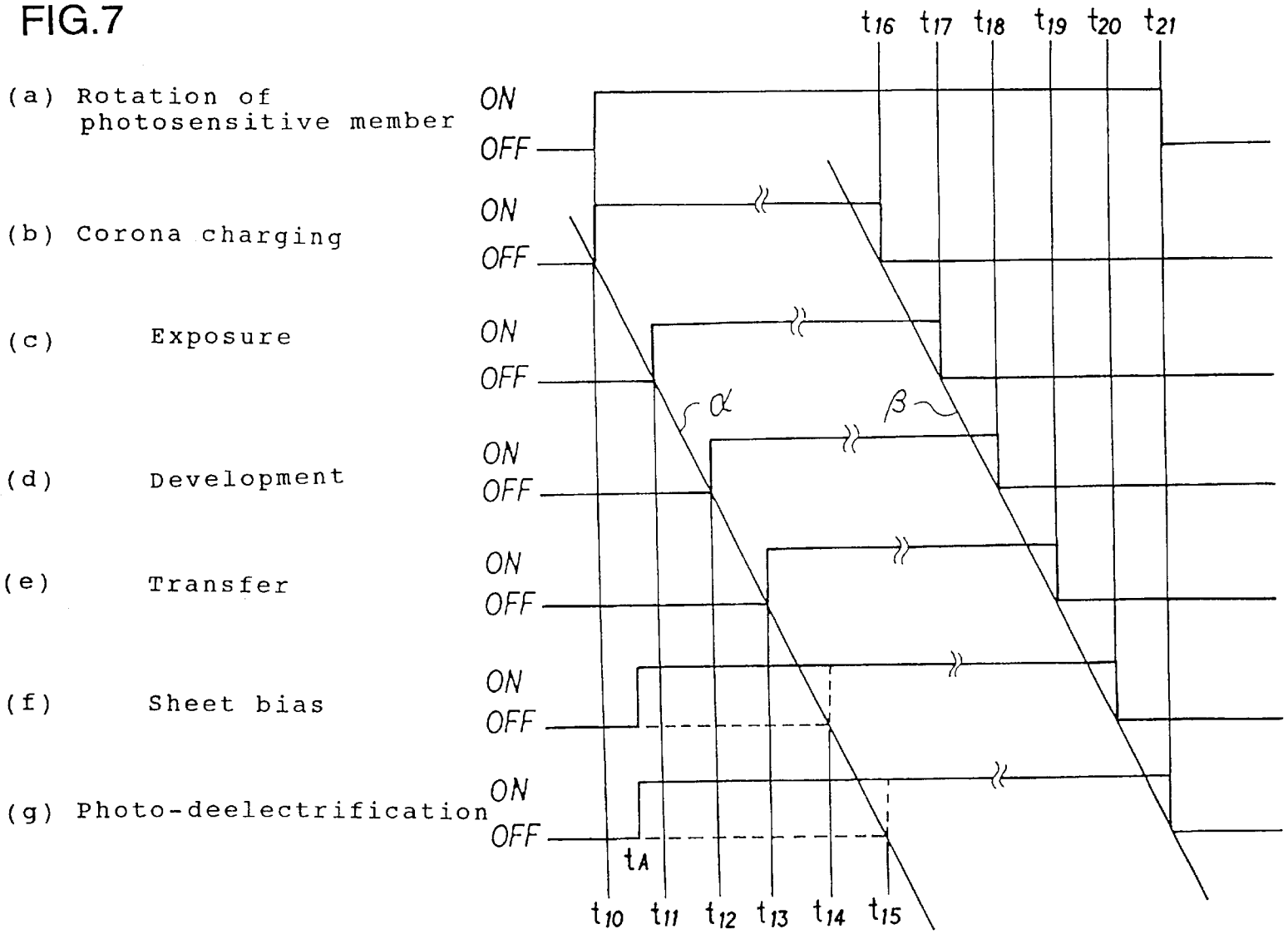
FIG. 7 is a view showing operation sequence for each device in consideration of time lag caused by rotation of the photosensitive drum.

In this respect, FIG. 6 is depicted as described above as if each device started the operation at the same time, but there is actually a time lag due to the rotation of the photosensitive drum 1. The operation sequence of the photosensitive drum 1 and each device in the vicinity thereof in consideration of this time lag will be described with reference to FIG. 7. In FIG. 7, diagonal lines $\alpha$ and $\beta$ indicate an aspect in which a certain place (hereinafter, referred to simply as "place") on the surface of the photosensitive drum 1 passes, in order, positions opposing to each device due to the rotation of the photosensitive drum 1. First, sequence of commencement of operation of each device will be described. As shown in FIG. 7, the Scorotron charger 2 also starts the operation (timing $t_{10}$) with start of rotational driving of the photosensitive drum 1. The place (hereinafter, referred to as "starting place") which is opposed to the Scorotron charger 2 at a point of timing $t_{10}$, reaches the exposure position at a point of timing $t_{11}$. At a point of timing $t_A$ before it, the operations of the contact charging sheet 71 and the photo-deelectrifying unit 8 are started prior to start of operations of other devices such as the laser exposure device 3. The operation of the contact charging sheet 71 is to be applied with bias voltage $V_B$ by the voltage applied circuit 72. Since this application of the bias voltage $V_B$ causes an electrostatic attraction force between the contact charging sheet 71 and the photosensitive drum 1, rotary resistance of the photosensitive drum 1 varies because of start of operation of the contact charging sheet 71, that is, switching of the bias voltage $V_B$ from off to on. This causes unevenness in the rotation of the photosensitive drum 1. Of course, it is possible to control so that the same rotary speed can be obtained before and after the application of bias voltage $V_B$ is started by correcting the driving torque of the photosensitive drum 1, but still the rotary unevenness in the moment (timing $t_A$) the application of bias voltage $V_B$ is started cannot be completely eliminated actually. At the point of this timing $t_A$, however, such process as exposure or transfer which directly affects the image quality is not performed, and therefore, this rotary unevenness does not appear as unevenness in the image.

Thereafter, when the starting place reaches the exposure position, exposure by the laser exposure device 3 is started (timing $t_{11}$), when the starting place reaches the developer unit 4, development by the developer unit 4 is started (timing $t_{12}$), and when the starting place reaches the transfer unit 5, transfer of a toner image onto a recording sheet 11 is started by the transfer unit 5 (timing $t_{13}$). Thereafter, the starting place reaches the contact charging sheet 71 and the photo-deelectrifying unit 8 at timing $t_{14}$ and $t_{15}$ respectively, but these devices have already started their operations respectively at the point of timing $t_A$. In other words, the timing $t_A$, which is timing of switching the bias voltage $V_B$ of the contact charging sheet 71 from off to on, is placed during a time period in which neither formation of an electrostatic latent image nor transfer by the transfer unit 5 is being performed. The foregoing is the sequence of start of operation in FIG. 7.

Subsequently, sequence of termination of operation will be described. It is the Scorotron charger 2 that terminates the operation first among each device. More specifically, at a point of time whereat predetermined time corresponding to the image size has elapsed since the start of operation at timing $t_{10}$, the electrifying operation is terminated (timing $t_{16}$). At this time, a place on the surface of the photosensitive drum 1 for opposing to the Scorotron charger 2 is a place (hereinafter, referred to as "terminating place") corresponding to the final position of the image. In this respect, in the present image forming apparatus 1, since the controller 10 recognizes the final position of the image on the basis of the digital image data, the final position does not mean an end of sheets for manuscript or the recording sheet 11, but actual final position of the image. Thus, when the terminating place reaches the exposure position, exposure is terminated (timing $t_{17}$), when the terminating place reaches the developer unit 4, the development is terminated (timing $t_{18}$), when the terminating place reaches the transfer unit 5, the transfer is terminated (timing $t_{19}$), when the terminating place reaches the contact charging sheet 71, the application of bias voltage $V_B$ is terminated (timing $t_{20}$), and when the terminating place reaches the photo-deelectrifying unit 8, the operation of the photo-deelectrifying unit 8 and the rotational driving of the photosensitive drum 1 are terminated (timing $t_{21}$). At a point of timing $t_{20}$ whereat the application of bias voltage $V_B$ is terminated, rotary unevenness of the photosensitive drum 1 occurs as at the commencement of the application (timing $t_A$). At this point of time, such process as exposure or transfer for directly affecting the image quality has already been terminated, and therefore, this rotary unevenness does not appear as unevenness in the image. In this respect, as described in FIG. 9 later, the terminated application of bias voltage $V_B$ to the contact charging sheet 71 may be delayed a little more than the timing $t_{20}$. The foregoing is the sequence of termination of operation in FIG. 7.

Next, the description will be made of a case where the bias voltage $V_B$ of the contact charging sheet 71 is not only merely on-off switched, but also switching between high level and low level is performed. Even when the level of bias voltage $V_B$ is switched, an electrostatic attraction force between the contact charging sheet 71 and the photosensitive drum 1 varies, and may cause rotary unevenness in the photosensitive drum 1, resulting in image noise. Therefore, it is necessary to prevent this. First, the brief description will be made of in what case switching between high level and low level of the bias voltage $V_B$ is performed. In an image forming apparatus of this type, there is a case where development efficiency varies because of causes such as fluctuation in toner density of developer in the developer unit 4 and toner coverage (hereinafter, referred to as "image density") of a toner image fluctuates. In order to maintain the image density constant in this case, control, in which potential difference between potential at the photosensitive layer 10 after exposure and applied voltage to the developer unit 4 is made variable, is performed. This variable control is performed by varying the grid voltage $V_G$ at the Scorotron charger 2. More specifically, if the image density is judged to be low, the grid voltage $V_G$ is increased, and if the image density is judged to be high, the grid voltage $V_G$ is decreased. The judgement as to whether the image density is high or low is performed by having, for example, a reflected light intensity sensor to detect the image density on the photosensitive drum 1 using this sensor. As described above, the surface potential on the photosensitive drum 1 is adjusted by the contact charging sheet 71 prior to the Scorotron charger 2. If the surface potential adjusted by the contact charging sheet 71 exceeds the electrified potential to be electrified by the Scorotron charger 2, the Scorotron charger 2 is not capable of reducing the potential at that portion to correct electrified potential. Accordingly, the contact charging sheet 71 must not cause the surface potential at the photosensitive drum 1 to exceed the electrified potential to be electrified by the Scorotron charger 2. If, when the image density is judged to be high and the grid voltage $V_G$ is reduced, the bias voltage $V_D$ to the contact charging sheet 71 remains unchanged, there is a possibility that the electrified potential will be exceeded at a point of time whereat the surface potential at the photosensitive drum 1 passes the contact charging sheet 71. In order to prevent this, it is necessary to switch the bias voltage $V_B$ from high level to low level.

Figure 8:
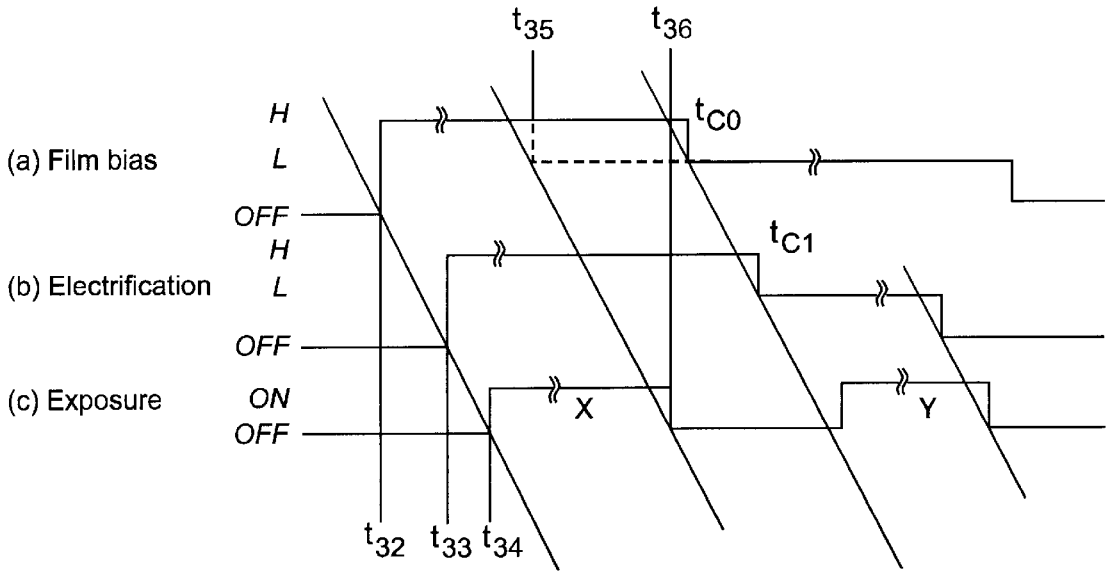
FIG. 8 is a view showing operation sequence when the level of bias voltage is switched in consideration of time lag caused by rotation of the photosensitive drum.

With reference to FIG. 8, the description will be made of the operation sequence of the contact charging sheet 71, the Scorotron charger 2 and the laser exposure device 3 in such control. FIG. 8 shows sequence in a case where there exist an image X and an image Y at an interval with each other and the level of the bias voltage $V_B$ to the contact charging sheet 71 must be different from each other between when the image X is formed and when the image Y is formed.

First, the sequence for start of the operation will be described. When the starting place reaches the contact charging sheet 71, application of the bias voltage $V_B$ is started (timing $t_{32}$). High-level voltage is applied here. When the starting place reaches the Scorotron charger 2, electrifying operation is started (timing $t_{33}$). In other words, application of grid voltage $V_G$ is started. High-level voltage is also applied to this as in the bias voltage $V_B$. Thus, when the starting place reaches the exposure position, exposure is started by the laser exposure device 3 (timing $t_{34}$). The foregoing is sequence for start of the operation. This start sequence starts formation of the image X.

When the density of the image X is judged to be high, the image Y to follow must be formed by low-level grid voltage $V_G$ or the like. On the completion of formation of the image X, the grid voltage $V_G$ and the like are changed. The sequence for the change will be described. First, even when the terminating place of the image X reaches the contact charging sheet 71, the level of the bias voltage $V_B$ is not changed at this point of time (timing $t_{35}$). This is because, since exposure is being performed by the laser exposure device 3 at this time, image noise resulting from rotary unevenness of the photosensitive drum 1 occurs when the level of the bias voltage $V_B$ is changed. For this reason, after the terminating place of the image X reaches the exposure position to terminate the exposure of the image X (timing $t_{36}$), the bias voltage $V_B$ is switched to a low level (timing $t_{CO}$).

Since clearance between image X and image Y is located at the exposure position and exposure is at rest at the time of this switching, rotary unevenness does not cause image noise to occur. When a place on the surface of the photosensitive drum 1 for opposing to the contact charging sheet 71 at the point of timing $t_{CO}$ reaches the Scorotron charger 2, the grid voltage $V_G$ is also switched to a low level, and thereafter, the image Y will be formed.

Figure 9:
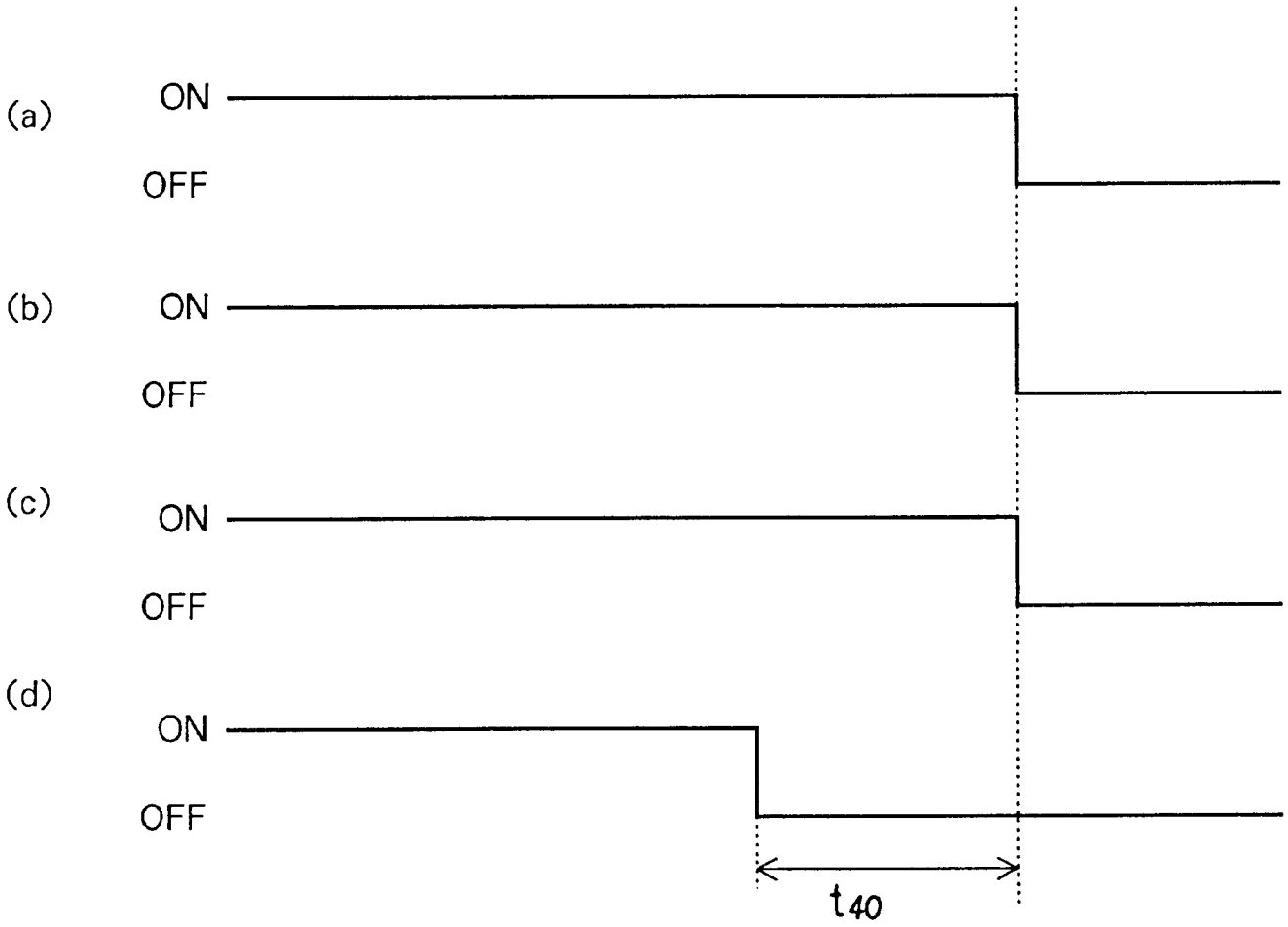
FIG. 9 is a sequence diagram showing timing of completion of operation for each device at the completion of image formation.

Next, the operation terminating timing for the contact charging sheet 71 at the shut-down will be supplementally described. Since the rotary speed of the photosensitive drum 1 is limited and there is a fixed interval between the transfer unit 5 and the contact charging sheet 71, if each device is turned off at the same time on terminating the operation, it is considered that a place whose potential polarity is reversed occurs in the photosensitive layer 10 according to the output from the transfer unit 5, and yet the place enters a stopped state before it reaches the contact charging sheet 71. Such a place is left intact with opposite polarity remaining. However, since the application of voltage to the contact charging sheet 71 is not stabilized immediately after resumption of operation during the next image formation, there is a possibility where it could not be completely returned to the correct polarity. In this case, if image formation is performed as it is, noise will enter the first image. Thus, the controller 9 first stops the transfer unit 5 at the shutdown, and thereafter, stops other devices (particularly the photosensitive drum 1 and the contact charging sheet 71) with predetermined time delayed. Namely, each device is stopped in accordance with the sequence shown in the timing chart of FIG. 9. In FIG. 9, (a) shows the rotation of the photosensitive drum 1, (b) shows shows the control of grid voltage at the Scorotron charger 2, (c) shows the control of applied voltage to the contact charging sheet 71, and (d) shows the control of output from the transfer unit 5. According to FIG. 9, after the transfer unit 5 in (d) is turned off, each of other devices is turned off with time $t_{40}$ delayed. Here, the time $t_{40}$ is taken longer than time (differs depending upon the circumferential speed and layout of each device for each type) required for the photosensitive layer 10 to reach the contact charging sheet 71 from the transfer unit 5 due to the rotation of the photosensitive drum 1. If this is applied to FIG. 7 described above, the termination of application of bias voltage $V_B$ to the contact charging sheet 71 will be delayed a little more than the timing $t_{20}$. Accordingly, the photosensitive layer 10, whose portion has passed the transfer unit 5, is certain to stop after passing the contact charging sheet 71, and therefore, any portion, whose potential polarity has been reversed, will not remain anywhere on the photosensitive layer 10. Therefore, a high-quality image can be obtained in the next image formation.

As described in detail above, the image forming apparatus according to this embodiment has been constructed such that the applied voltage to the contact charging sheet 71 is caused to interlock with the grid voltage, and that control is performed by the controller 9 in which the potential at the photosensitive layer 10 at a point of time passing the contact charging sheet 71 is caused not to exceed the predetermined potential to be electrified by the Scorotron charger 2. Therefore, the photosensitive layer 10 can be uniformly electrified at the predetermined voltage by the Scorotron charger 2, and a high-quality image free from noise can be obtained. Further, a cumulative number of times for image formation of the image forming apparatus ever since it was new is added, and control is performed in which the influence of reduction in the film thickness L of the photosensitive layer 10 due to the use is corrected. Therefore, a high-quality image free from noise can be obtained even if it is repeatedly used, to say nothing of when it was new.

The structure is arranged such that the applied voltage $V_S$ to the contact charging sheet 71 is increased in accordance with the output from the transfer unit 5, and that the photosensitive layer 10 with its portion whose potential polarity has been reversed remaining thereon is prevented from reaching the Scorotron charger 2. Therefore, even if the output from the transfer unit 5 fluctuates, uniform electrification can be obtained by the Scorotron charger 2 to form a high-quality image free from noise. Also, by including the size of the printing sheet in the controling factor at this time, the electrification of the photosensitive layer 10 can be controlled more strictly.

Also, further after the additional treatment performed following the image forming process, a cleaning process for applying AC bias is performed for the contact charging sheet 71 for contacting the photosensitive drum 1 to impart charge. Therefore, even if foreign matter accumulates on the contact place between the photosensitive drum 1 and the contact charging sheet 71, the foreign matter accumulated is shaken off by the oscillation of the contact charging sheet 71 in the cleaning process to restore to a clean state. For this reason, the performance of the contact charging sheet 71 is prevented from being deteriorated by the accumulated foreign matter, and it is possible to continue to form a high-quality image by means of the photosensitive drum 1.

Also, by slowing down or stopping the rotation of the photosensitive drum 1 during the cleaning process, the oscillation of the contact charging sheet 71 by AC bias is prevented from striking our ears as oscillation noise, and a quiet image forming apparatus can be provided even during cleaning. Further, by stopping (case of FIG. 4) application of DC bias to the contact charging sheet 71 during the cleaning process, or by applying (case of FIG. 6) DC bias, one (such as paper filler) electrified of foreign matter is prevented from being introduced into the contact charging sheet 71 by relationship with electrified potential of the photosensitive drum 1 at a point of time of the cleaning process, and therefore, an image forming apparatus having high cleaning effect is provided. Since there is no need for a mechanism for mechanically moving the contact charging sheet 71 in this case, each effect described above can be obtained with simple and compact apparatus configuration. Also, bias voltage $V_B$ is applied to the contact charging sheet 71 through the voltage applied circuit 72 to de-electrify the photosensitive drum 1 together with the photo-deelectrifying unit 8. The start and termination of application of the bias voltage $V_D$ are performed while neither exposure nor transfer is being performed, and therefore, rotary unevenness of the photosensitive drum 1 occurs while exposure or transfer is being performed so that it does not appear in an image to be formed as stripe-pattern noise. Accordingly, an image forming apparatus capable of forming a high-quality image is provided.

Also, the contact charging sheet is used as a de-electrifying unit, and the photosensitive drum 1 is electrified using the Scorotron charger 2. However, since the level of the bias voltage $V_B$ is changed while no exposure is being performed, rotary unevenness of the photosensitive drum 1 occurs while exposure is being performed so that it does not appear in an image to be formed as stripe-pattern noise. Accordingly, an image forming apparatus capable of forming a high-quality image is provided.

In this respect, in the above-described embodiment, the description has been made of a case where the level of bias voltage $V_B$ is changed from high to low, but the same applies to a case where it is changed from low to high to the contrary, or a case where the polarity is converted when the contact charging sheet 71 is constructed to be used in common for electrification and de-electrification.

Further, on terminating the image formation operation, the termination of operations of other devices such as the photosensitive drum 1 and the contact charging sheet 71 is delayed with respect to the termination of the operation of the transfer unit 5, and a portion of the photosensitive layer 10, into which current from the transfer unit 5 has flowed, is caused to stop after passing the contact charging sheet 71. Therefore, the photosensitive layer 10 does not enter a rest state with a portion whose potential polarity has been reversed remained therein, but the next image formation can be performed in high quality. In this respect, the present invention is not limited to the above-described embodiment. It goes without saying that various changes and modifications can be made without departing from the spirit and scope thereof. For example, concrete numerals shown for dimensions, film thickness and the like, and the concrete material for the contact charging sheet 71 are merely exemplified. Also, any device other than shown in FIG. 1 and the like may be added. Further, the Scorotron charger 2 is not limited to wire. A needle electrode or a (saw-tooth shaped) electrode in which a plurality of acute discharge end portions are arranged in a row may be used. Also, the transfer unit 5 is not limited to a transfer roller Film or brush, stationary or rotary type, and non-contact type (corona discharge) may be used.

Further, DC bias and AC bias are superposed one upon the other to be applied to the contact charging sheet 71 during image formation, but it is also possible not to apply AC bias. Further, in the above-described embodiment, the contact charging sheet 71 is used with the aim of de-electrifying after the photosensitive drum 1 is returned to the same polarity as electrification together with the photo-deelectrifying unit 8, but structure in which the contact charging sheet 71 is used as an electrifying unit or as a de-electrifying unit is also conceivable. In this case, when a portion at high potential is de-electrified, bias voltage with opposite-polarity to electrification is applied. After the cleaning process, foreign matter and the like adhering to the contact charging sheet 71 will be collected in a recovery unit such as the cleaner 6, but structure to positively bring them to the cleaner and the like may be adopted.

In this respect, in this embodiment, although the image forming apparatus comprises the photo-deelectrifying unit 8 to de-electrify the photosensitive drum 1 by the cooperation with the contact charging sheet 71 and the photo-deelectrifying unit 8, structure in which the photo-deelectrifying unit 8 is omitted and only the contact charging sheet 71 is used for de-electrifying may be adopted.

Also, while a fixed type has been considered as the contact charging sheet 71, it is possible to make it movable so that it is kept away from the photosensitive drum 1 except when bias voltage $V_D$ is applied. However, since a sheet or a brush which is a fixed object (when bias is applied) has greater change in driving resistance due to variations in an electrostatic attraction force than a roller which is a rotatable object, the effect is more noticeable. Further, the sheet is more greatly affected due to variations in the electrostatic attraction force than the brush since it is used in a lightly pressed state, and the effect is more noticeable.

The quantity and positions of the contact charging sheets 71 can be considered in various ways in addition to those described in the embodiment (such as in front of the cleaner 6). Further, the present invention is applicable not only to the digital exposure type, but also to the analog exposure type image forming apparatus. However, the digital type is more sensitive to rotary unevenness of the photosensitive drum 1 because of exposure scanning partitioned into very small areas, and therefore, the effect is that much noticeable. Also, the digital type is convenient in that a range in which there is no actual image even within a manuscript can be utilized for switching the bias voltage, or is applicable to such an apparatus as to form a latent image on dielectric material by ion deposition in addition to the electrophotographic method.

In this respect, if the DC voltage and AC voltage which are superposed are used as applied voltage to the contact charging sheet 71, it should be noted that insulation breakdown is likely to occur when the absolute value of voltage peak obtained by superposing DC voltage and AC voltage becomes too high. Concretely, it is necessary to control so that the absolute value for the voltage peak does not exceed 80 L(V) with respect to the film thickness L($\mu$m) of the photosensitive layer 10. Since the film thickness L depends upon the cumulative number of times for image formation as described above, it becomes necessary to control so as to reduce the AC voltage in accordance with the service history.

What is claimed is:

1. An image forming apparatus, comprising:

an image bearing member having a surface;

electrifying means for electrifying the surface of said image bearing member;

latent image forming means for forming an electrostatic latent image on the surface of said image bearing member electrified by said electrifying means;

development means for visualizing the electrostatic latent image formed by said latent image forming means;

transfer means for transferring the image visualized by said development means;

charging means for imparting charge to the surface of said image bearing member in a position behind said transfer means and before said electrifying means; and charge control means for controlling an applied voltage to said charging means so that a surface potential at said image bearing member does not exceed predetermined potential.

2. An image forming apparatus as defined in claim 1, wherein said charging means includes a contact member rubbed with the surface of said image bearing member.

3. An image forming apparatus as defined in claim 2, wherein said contact member is sheet-shaped.

4. An image forming apparatus as defined in claim 1, wherein predetermined potential used by said charge control means to control said charging means is potential at which the surface of said image bearing member is electrified by said electrifying means.

5. An image forming apparatus as defined in claim 1, further comprising cleaning means for cleaning the surface of said image bearing member in a position behind said transfer means and before said charging means.

6. An image forming apparatus as defined in claim 1, wherein said charge control means controls the applied voltage to said charging means in accordance with an image formation condition.

7. An image forming apparatus as defined in claim 6, wherein said image formation condition is transfer voltage at said transfer means.

8. An image forming apparatus as defined in claim 6, wherein said image formation condition is a cumulative number of times for image formation operation.

9. An image forming apparatus as defined in claim 6, wherein said image formation condition is an image formation area.

10. An image forming apparatus as defined in claim 1, wherein the applied voltage to said charging means is DC voltage.

11. An image forming apparatus as defined in claim 1, wherein the applied voltage to said charging means is oscillating voltage.

12. An image forming apparatus as defined in claim 1, wherein the applied voltage to said charging means is DC voltage and oscillating voltage which are superposed.

13. An image forming apparatus as defined in claim 1, wherein said charge control means applies oscillating voltage to said charging means during non-image formation to clean said charging means.

14. An image forming apparatus as defined in claim 13, wherein said apparatus has driving control means for controlling driving of said image bearing member and said driving control means reduces a driving speed of said image bearing member when said charge control means cleans said charging means.

15. An image forming apparatus as defined in claim 13, wherein said charge control means does not apply DC voltage to said charging means when cleaning said charging means.

16. An image forming apparatus as defined in claim 1, wherein said electrifying means is opposite in polarity to said transfer means.

17. An image forming apparatus as defined in claim 1, wherein said charge control means does not switch the applied voltage to said charging means when said latent image forming means forms an electrostatic latent image.

18. An image forming apparatus as defined in claim 17, wherein said charge control means does not switch the applied voltage to said charging means during transfer by said transfer means.

19. An image forming apparatus as defined in claim 1, wherein said charge control means switches the applied voltage to said charging means after an output from said transfer means is switched.

20. An image forming method, comprising the steps of:

electrifying a surface of an image bearing member to predetermined potential;

forming an electrostatic latent image on the surface of said image bearing member electrified;

visualizing the electrostatic latent image formed on the surface of said image bearing member;

transferring the visualized image; and applying voltage to the surface of said image bearing member within a range in which a surface potential of said image bearing member does not exceed said predetermined potential.

21. An image forming method as defined in claim 20, wherein in a step of applying voltage to the surface of said image bearing member, the voltage is applied using a contact member rubbed with the surface of said image bearing member.

22. An image forming method as defined in claim 21, further comprising a step of cleaning said contact member by applying oscillating voltage to said contact member during non-image formation.

23. An image forming method as defined in claim 22, wherein a driving speed of said image bearing member is reduced during said cleaning.

* * * * *